US005149163A

United States Patent [19]

Pruitt

[11] Patent Number: 5,149,163

[45] Date of Patent: Sep. 22, 1992

[54] ON AND OFF FISHING TOOL

[75] Inventor: Jackie D. Pruitt, Levelland, Tex.

[73] Assignees: Well-o Oil Service, Inc., Brownfield; Felipe Hernandez, Levelland, both of Tex. ; a part interest to each

[21] Appl. No.: 456,314

[22] Filed: Dec. 26, 1989

[51] Int. Cl.[5] ..... E21B 31/18

[52] U.S. Cl. ..... 294/86.31; 294/86.32; 294/86.33

[58] Field of Search ..... 294/86.17, 86.19, 86.26, 294/86.3–86.33, 102.2; 166/98, 99, 301

[56] References Cited

U.S. PATENT DOCUMENTS

| | | | |
|---|---|---|---|
| 1,797,505 | 3/1931 | Jones et al. | 294/86.33 |
| 1,869,861 | 8/1932 | O'Bannon | 294/86.31 |
| 2,232,949 | 2/1941 | Jones et al. | 294/86.31 |
| 2,250,440 | 7/1941 | Shannon | 294/86.31 X |
| 2,753,208 | 7/1956 | Le Bus | 294/86.31 X |
| 3,549,187 | 12/1970 | Harbison | 294/86.31 |
| 3,727,967 | 4/1973 | Anastasiu et al. | 294/86.31 |

FOREIGN PATENT DOCUMENTS

| | | | |
|---|---|---|---|
| 241255 | 10/1925 | United Kingdom | 294/86.31 |
| 2104937 | 3/1983 | United Kingdom | 294/86.32 |

*Primary Examiner*—Johnny D. Cherry
*Attorney, Agent, or Firm*—Wendell Coffee

[57] ABSTRACT

A fishing tool for composite sucker rod has a four fingered collet. An overshot tube is connected to the top of the fishing tool. The top of the collet has a stack telescoped within a helical spring. A fish deep within a well has a splintered partial joint of composite rod above a metal coupling having a four faced wrench flat. In operation, the splintered joint is telescoped within the overshot and the four fingers engage the four faced wrench flat. The tool is disengaged by rotating the tool $\frac{1}{8}$ of a turn to bring the collet fingers over the corners between the flat faces of the wrench flat.

2 Claims, 2 Drawing Sheets

ON AND OFF FISHING TOOL

RIGHTS TO INVENTIONS UNDER FEDERAL RESEARCH

There was no federally sponsored research and development concerning this invention.

BACKGROUND OF THE INVENTION (1) Field of the Invention (skill in the art)

This invention relates to oil field equipment and more particularly to a fishing tool for broken sucker rods and specifically a fishing tool for broken composite sucker rods having metal couplings.

People using fishing tools to fish for sucker rods have ordinary skill in this art.

(2) Description of the Related Art

At the present time in oil wells, composite sucker rods are often used. Sometimes composite sucker rods are referred to as fiberglass sucker rods.

Typically composite sucker rods will be made up with joints of a composite rod of about 37 feet in length connected by metal couplings. The metal couplings are typically cylindrical in shape except for wrench flats. Normally they will have wrench flats which will have four faces. I.e., they will form a square. Normally the diagonal of the square will be about the same as or slightly longer than the diameter of the cylinder on which it is formed. Normally a fishing neck is not formed upon the metal coupling of composite rods.

The failure of the fiberglass rod is usually in the fiberglass. Also when the fiberglass fails, it often leaves a splintered end.

Therefore a typical fish for a fiberglass sucker rod will include a long length of fiberglass having an upper portion that is splintered and a coupling without a fishing neck below the broken rod. Somewhere below the broken rod the sucker rod will be stuck within the well. Normally the surface of the sucker rod is such that it cannot be gripped with sufficient tightness to unstick it.

Often times in fishing it is desirable to be able to release the fish or disengage the fish.

Before this application was filed, the applicant was aware of the following U.S. Pat. Nos.:

| | | |
|---|---|---|
| KINLEY | 1,645,010 | October 11, 1927 |
| THOMPSON | 1,750,248 | March 11, 1930 |
| O'BANNON | 1,828,938 | October 27, 1931 |
| HINDERLITER | 1,858,500 | May 17, 1932 |
| O'BANNON | 1,869,861 | August 2, 1932 |
| NEILSON | 2,096,525 | October 19, 1937 |
| JUSTICE | 2,970,859 | February 7, 1961 |
| KENNARD | 2,973,037 | February 28, 1961 |
| WOOLLEY | 3,393,002 | July 16, 1968 |
| HARBISON | 3,549,187 | December 22, 1970 |
| WEBB | 4,023,847 | May 17, 1977 |
| TAYLOR | 4,185,865 | January 29, 1980 |

THOMPSON as early as 1930 had invented a collet type fishing tool for sucker rods.

O'BANNON '861, in 1932 discloses a fishing tool which is commonly on the market today. It may be seen that it has a three fingered collet which is designed to specifically engage a fishing neck of a metal coupling of a metal sucker rod.

HARBISON in 1969 disclosed a particular tool which was designed to engage either a broken metal rod or some particular protruding part of a coupling.

TAYLOR discloses a releaseable wire line overshot using a collet. TAYLOR is releaseable by a cam and ratchet mechanism within the tool itself independent of the fish being caught and/or released.

Applicant does not believe the Examiner would consider the remaining patents relevant or pertinent to the examination of this application but applicant thinks that the Examiner would be interested in what was reported by an experienced patent searcher.

SUMMARY OF THE INVENTION (1) Progressive Contribution to the Art

I have invented a releaseable or on and off fishing tool particularly adapted to fish composite sucker rod. This invention solves the problem by having a collet chuck adapted to engage the four faced wrench flats upon the coupling. So that the collet tool may engage the wrench flat, it is necessary to have an overshot tube above the collet to telescope over or swallow the partial joint which is broken and above the coupling. Also for the collets to engage the four faced wrench flat it is necessary that they have four fingers, one finger fitting over each face.

I have found that with the four fingers that if the collet and the engaging portion of the collet are at the same level as the wrench flats and if the collet is rotated so that the fingers are rotationally aligned with the faces, that they will properly engage them. However, then if the collet is released and is rotated ⅛ of the turn so that the fingers are aligned with the corners (instead of the flats) that the upward movement of the collet will disengage itself from the fish.

The splintered top of the partial joint tends to get hung in the spring which otherwise forces the collet downward within its bowl. An upper portion of the collet called a stack extends and is telescoped within the spring to prevent this from occurring.

(2) Objects of this Invention

An object of this invention is to catch a composite sucker rod fish.

Another object of this invention is to catch and release a composite sucker rod fish.

Further objects are to achieve the above with devices that are sturdy, compact, durable, lightweight, simple, safe, efficient, versatile, ecologically compatible, energy conserving, and reliable, yet inexpensive and easy to manufacture, connect, operate and maintain.

Other objects are to achieve the above with a method that is rapid, versatile, ecologically compatible, energy conserving, efficient, and inexpensive, and does not require highly skilled people to connect, operate, and maintain.

The specific nature of the invention, as well as other objects, uses, and advantages thereof, will clearly appear from the following description and from the accompanying drawing, the different views of which are not scale drawings.

As an aid to correlating the terms of the claims to the exemplary drawing, the following catalog of elements is provided:

| | |
|---|---|
| 10 casing | 43 bevel |
| 12 fiberglass sucker rod | 44 internal flange |
| 14 broken joint | 46 internal taper |
| 16 splintered top end | 48 helical compression spring |
| 18 metal couplings | 50 shoulder |
| 19 ledge | 52 shoulder |
| 20 four faces | 54 four fingers |
| 22 bore | 56 slots |
| 24 convex face | 58 guides |
| 30 fishing tool | 59 bevel |
| 32 sucker rod string | 60 engaging hooks |
| 34 elongated overshot | 62 stack |
| 36 threads | |
| 38 tubular adaptor | |
| 40 bowl | |
| 42 collet | |

DESCRIPTION OF THE PREFERRED EMBODIMENT(S)

Figure 1:
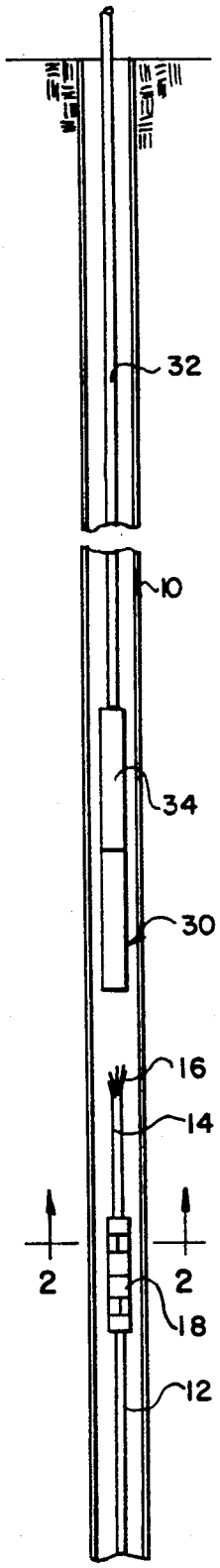
FIG. 1 is a schematic representation of a fishing tool according to this invention mounted upon a string of sucker rod which is within a well and above a composite sucker rod having metal coupling with the broken joint of the composite rod splintered at its top.
Figure 2:
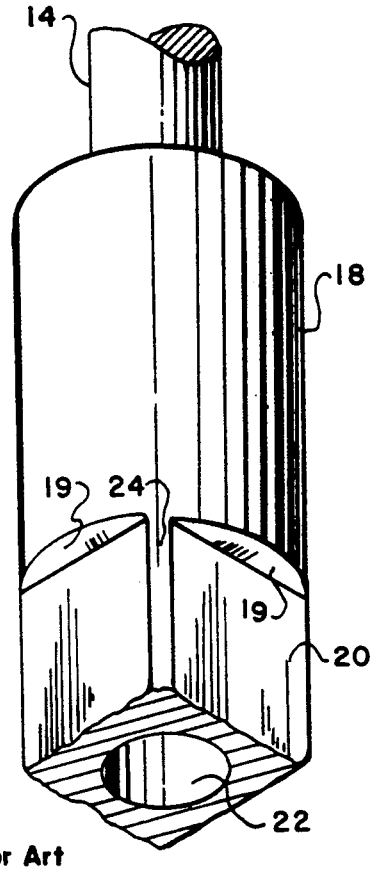
Prior Art FIG-2
FIG. 2 is a perspective view of the metal coupling and composite rod which as shown is cut at about line 2—2 of FIG. 1.
Figure 3:
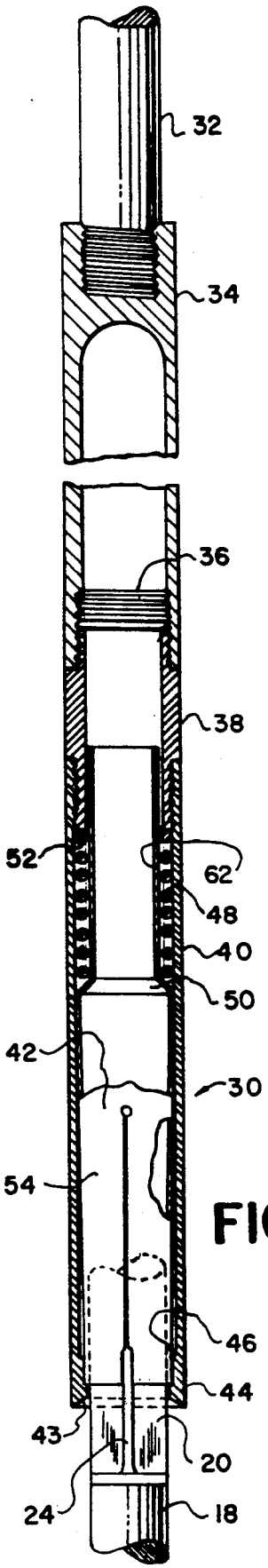
FIG. 3 is an axial sectional view of a tool connected to an overshot according to this invention.

Referring to the drawings more particularly, in FIG. 1 there may be seen a well deep within the ground having casing 10. Within the well there is shown composite rod 12. At the top of the sucker rod there is shown broken joint 14 having splintered top end 16. The sucker rod 12 would be stuck within the well below metal coupling 18. Since the sucker rod stuck, it would be a "fish".

The metal coupling 18 has four faces 20 milled therein which forms a wrench flat for attaching and releasing the adjacent joints of sucker rod.

It will be noted that the attachment of the fiberglass sucker rod 12 into the coupling 18 necessitates the coupling have bore 22 through the coupling. For this reason the wrench flats formed by wrench faces 20 are rather shallowly cut. The four faces of the wrench flat are a square. The diagonal of the square is greater than the diameter of the coupling 18. Therefore there will be a small convex face 24 at each of the corners of the wrench flats 20. The convex faces 24 are a continuation of the cylindrical surface of coupling 18 itself. Ledge 19 is formed at the top of the wrench flats where the metal is removed to form them.

There are certain points which illustrate the problem, i.e. the splintered end 16 of the broken joint 14 and the distance between the splintered end 16 and the coupling 18, also the fact that there is no fishing neck upon the coupling 18. It will be noted that the absence of fishing necks and the shallow wrench flats are due to the loss of the metal within the couplings necessitated by the bore 22 extending through it.

Those with ordinary skill in the art will recognize the description of the sucker rod and couplings to this point is old and well known to those having ordinary skill in the art and describe the sucker rod itself.

This application discloses a fishing tool 30 particularly adapted to fish the broken sucker rod joint 14 and the remainder of the sucker rod string extending below the coupling 18 from the well.

The tool is adapted to be attached to a sucker rod string 32. This string is preferably the portion of the string of the fish 12. I.e., the upper part of the composite sucker rod which includes the upper portion of the broken joint 14 and the composite rod above it is removed from the well and the broken portion of the joint with its coupling is removed. The advantage of using the sucker rod string which is above the broken joint 14 is that the upper broken portion may be measured and therefore there is an exact measurement of the distance in the well until the splintered end 16 should be encountered.

The sucker rod string 32 is attached to elongate overshot 34. The half coupling at the bottom of sucker rod 32 is not shown in the drawing for simplicity. As noted above the composite sucker rod joints are about 37 feet in length. The point where the sucker rod may be broken and splintered at 16 may be anywhere along the joint. Therefore it is desirable that the overshot be tubular and of sufficient length that it can reach over an entire joint of broken composite sucker rod.

The bottom of the overshot 34 contains threads 36 by which the overshot may be connected to tubular adaptor 38. Tubular adaptor 38 is in turn connected to the top of bowl 40 of the fishing tool 30. It may be seen that through the adaptor 38 the bottom of the overshot is connected to the top of the bowl. Collet 42 is telescoped within the bowl 40.

The lower edge of the bowl 40 has an internal flange 44 which limits the downward travel of the collet 42. Internal taper 46 is located within the bowl 40 a short distance above the flange 44. It is the taper 46 which closes the collet to engage the fish. The upper portion of the collet is biased downward by helical compression spring 48. The bottom portion of the helical compression spring 48 bears against shoulder 50 of the collet 42. The upper portion of the spring 48 bears against shoulder 52 upon the bottom of the adaptor 38. As described to this point, those with skill in the art will recognize that the fishing tool 30 is quite similar to the fishing tool shown in O'BANNON U.S. Pat No. 1,869,861.

According to my invention there are four fingers 54 of the collet 42. The fingers are formed by slots 56 between the fingers. The lower portion of these slots 56 are enlarged to form guides 58. The inward part of the fingers 54 have engaging hooks 60 on the inside thereof to engage the fish. Specifically the hooks engage the ledge 19 at the top of the wrench flats 20. Guides 58 extend for a length at least as great as the hooks 60.

The collet 42 has stack 62 above the shoulder 50. The stack 62 telescopes within the helical spring 48 and extends for the full length thereof.

Having described the tool the operation of it is as follows. First, of course, the tool is assembled by placing the fishing tool 30 upon the overshot 34. Because the length of the overshot is about 40 feet, the overshot may be in two or more sections conveniently screwed together. The only limitation is that it have a sufficient inside diameter to accommodate the broken joint 14 with its splintered end 16.

With the tool assembled then the overshot with the tool embodiment is attached to the sucker rod and is lowered into the well, until the bottom of the fishing tool 30 will reach the splintered end 16. Because of bevel 43 of the bottom of the fishing tool, the splintered end will be aided in being threaded into the fishing tool. Also the bottom of each of the collet fingers will have bevel 59 so that the splintered end will be fed on into the collet cavity. Likewise, at the top of the collet cavity, the shoulder 50 is tapered to angle upward from the inside so that the splintered end is fed into the stack 62. The stack has a smooth interior and the purpose of the stack is to prevent the splintered end 16 being caught within the coils of the helical spring 48.

Figure 4:
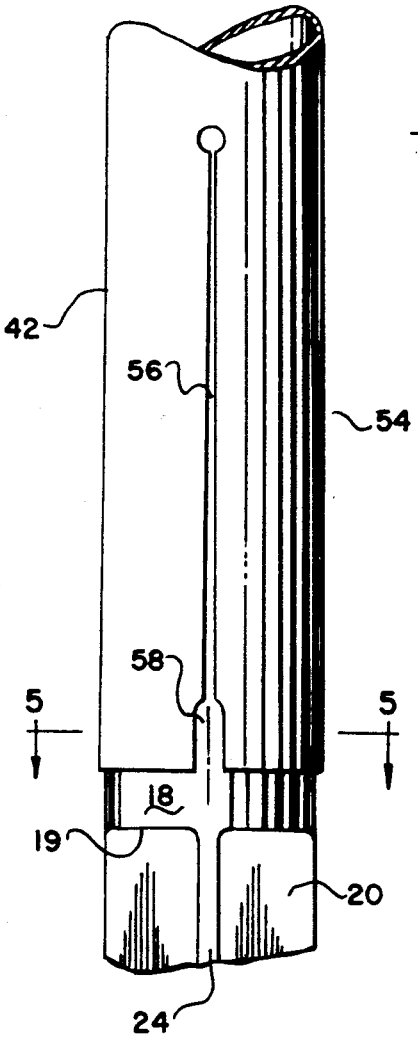
FIG. 4 is a side elevational view of the collet of the fishing tool positioned on the upper cylindrical portion of a coupling.
Figure 6:
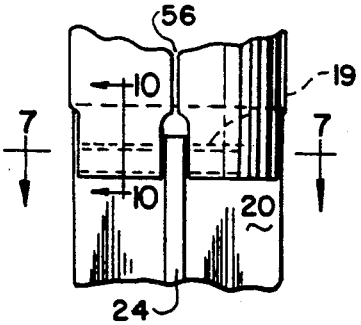
FIG. 6 is an elevational view of the collet and couplings substantially similar to FIG. 4, but showing the fish after it is caught.
Figure 10:
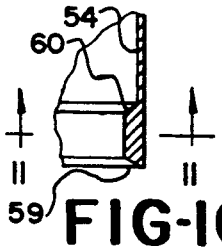
FIG. 10 is a detail of the collet hook taken substantially along line 10—10 of FIG. 6.
Figure 11:
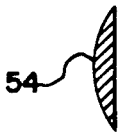
FIG. 11 is a sectional view of the body of the hook taken substantially along line 11—11 of FIG. 10.
Figure 7:
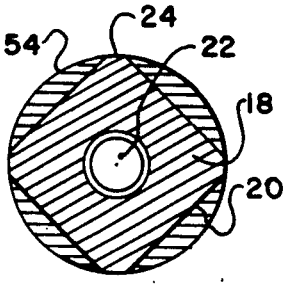
FIG. 7 is a cross-sectional view taken substantially on line 7—7 of FIG. 6.
Figure 5:
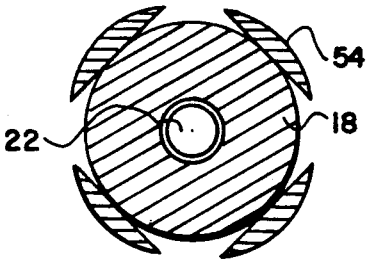
FIG. 5 is a cross-sectional view taken substantially along line 5—5 of FIG. 4.

The tool is lowered until the lower fingers of the tool reach the top of the coupling 18. As the tool is lowered the fingers 54 will move into an open position as seen in FIGS. 4 and 5. I.e., the fingers will ride up on the coupling. This is also aided by the bevel 59 at the bottom of the fingers. Then, as the tool 30 is lowered more, the collet jaws with the hooks 60 will be at the same level as the four flat faces 20 of the wrench flat. The tool may be brought into rotational alignment as well as being at the same level as the wrench flats. At that point, the spring 48 will force the fingers inward against the flat faces of the collet as seen in FIGS. 6 and 7. At this point, the fish is caught and as the tool 30 is moved upward by upward movement of the sucker rod string 32, it will pull the fish upward.

Figure 9:
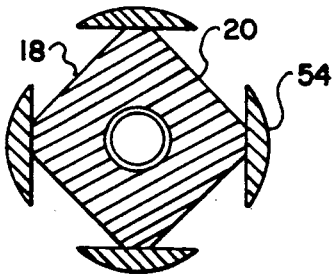
FIG. 9 is a cross-sectional view taken substantially along line 9—9 of FIG. 8.
Figure 8:
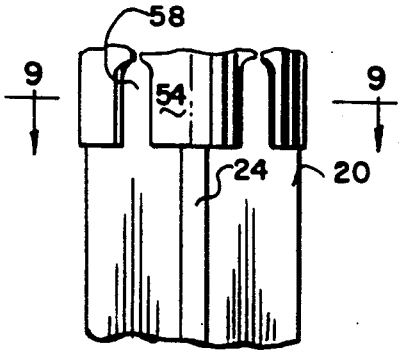
FIG. 8 is a elevational view of the collet and coupling substantially similar to FIG. 4 and FIG. 6 showing the collet in the released or "off" position.

If, after having caught the fish, for some reason it is desired to release the fish, the tension on the tool 30 is released by lowering the tool slightly. Then the tool is rotated ⅛ of a revolution so that the fingers 54 are aligned with the convex portions 24 as seen in FIGS. 8 and 9. The collet will be in the open position. Upward movement of the tool will cause the tool 30 to disengage the fish.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. The process of fishing in a deep well for a. a composite sucker rod fish having b. a splintered partial joint above c. a metal coupling having d. a four faced wrench flat thereon, e. said coupling connected to a stuck sucker rod extending down into the well, f. said four faces of the wrench flat forming a square, g. the diagonal distance of the square being equal to or greater than the diameter of the coupling wherein the wrench flat is formed;

wherein the improved method of engaging and disengaging the fish by a four fingered collet fishing tool comprises:

h. lowering said four fingered fishing tool over the splintered partial joint thereby telescoping the partial joint within a tubular overshot portion of the fishing tool, i. continuing to lower the collet until the four fingers are at the same level as the wrench flat of the fish coupling, j. rotating the four fingered collet until the four fingers are rotationally aligned with the four faces of the coupling, k. raising the fishing tool thereby engaging the four fingers with the wrench flats thus l. catching the fish, thereafter m. lowering the fishing tool to relax the four fingers upon the four faces, then n. rotating the four fingered collet ⅛ of a turn thereby o. aligning the four fingers with the four corners of the square formed by the four faces of the wrench flat, thereby p. releasing the collet from the wrench flat, and finally q. raising the tool, thereby r. disengaging the tool from the fish.

2. Structure for removing broken sucker rod in a deep well having a. a composite sucker rod having b. a splintered partial joint above c. a metal coupling having d. a four faced wrench flat thereon with a ledge at the top of each wrench flat, and e. said coupling connected to a stuck sucker rod extending down in the well;

the improved tool in combination with the above comprising:

f. a tubular overshot about 40 feet in length having a top and bottom end telescoped over the splintered partial joint, g. a tubular bowl having a top and bottom attached at its top to the bottom end of the overshot, h. a four fingered collet having a top and a bottom telescoped within said bowl, hh. a hook on each collet finger engaged with said ledge at the top of each wrench flat, i. a tubular stack connected to the top of said collet, j. a shoulder between said collet and said stack, k. said shoulder angled upward from the inside so that the splintered partial joint is guided from the collet into the stack, l. a helical compression spring telescoped around said stack and extending from the top of the bowl to the shoulder between the collet and said stack, m. an internal flange at the bottom of the bowl to limit the downward travel of the collet, and n. an internal taper within the bowl a short distance above said internal flange.

* * * * *